US010105584B1

(12) United States Patent
Whitcomb

(10) Patent No.: US 10,105,584 B1
(45) Date of Patent: Oct. 23, 2018

(54) BODY PROTECTIVE PADDING WITH NON-BURSTING GAS CELLS

(71) Applicant: John E. Whitcomb, Elm Grove, WI (US)

(72) Inventor: John E. Whitcomb, Elm Grove, WI (US)

( * ) Notice: Subject to any disclaimer, the term of this patent is extended or adjusted under 35 U.S.C. 154(b) by 111 days.

(21) Appl. No.: 14/682,172

(22) Filed: Apr. 9, 2015

Related U.S. Application Data

(63) Continuation of application No. 14/588,998, filed on Jan. 5, 2015, now Pat. No. 9,820,524, which is a continuation of application No. 14/337,582, filed on Jul. 22, 2014.

(60) Provisional application No. 61/967,291, filed on Mar. 10, 2014, provisional application No. 61/962,916, filed on Nov. 13, 2013.

(51) Int. Cl.

| | |
|---|---|
| ***A41D 13/05*** | (2006.01) |
| ***A63B 71/08*** | (2006.01) |
| ***A63B 71/12*** | (2006.01) |
| ***A41D 13/015*** | (2006.01) |

(52) U.S. Cl.
CPC ..... *A63B 71/081* (2013.01); *A41D 13/0155* (2013.01); *A41D 13/0506* (2013.01); *A41D 13/0518* (2013.01); *A63B 71/12* (2013.01)

(58) Field of Classification Search
CPC . A63B 71/081; A63B 71/12; A63B 2071/083; A63B 2071/1208; A41D 13/0518; A41D 13/0512; A41D 13/0155
See application file for complete search history.

(56) References Cited

U.S. PATENT DOCUMENTS

| | | | | | |
|---|---|---|---|---|---|
| 2,247,961 | A | * | 7/1941 | Mulvey | A63B 71/081 2/23 |
| 3,550,159 | A | * | 12/1970 | Alarco | A41D 13/0518 2/16 |
| 3,577,305 | A | * | 5/1971 | Hines | A41D 13/0155 2/243.1 |
| 3,640,831 | A | * | 2/1972 | Gardner | A63B 71/081 428/475.5 |
| 3,872,511 | A | | 3/1975 | Nichols | |
| 3,999,220 | A | | 12/1976 | Keltner | |
| 4,287,250 | A | | 9/1981 | Rudy | |
| 4,507,801 | A | * | 4/1985 | Kavanagh | A41D 13/015 2/267 |
| 4,586,200 | A | | 5/1986 | Poon | |
| 5,129,107 | A | | 7/1992 | Lorenzo | |
| 5,263,203 | A | | 11/1993 | Kraemer et al. | |
| 5,669,079 | A | | 9/1997 | Morgan | |

(Continued)

*Primary Examiner* — Sally Haden
(74) *Attorney, Agent, or Firm* — Donald J. Ersler

(57) ABSTRACT

Body protection padding with non-bursting gas cells preferably includes at least one base shell, an inside gas cell impact layer and an outside gas cell impact layer. The gas is preferably air, but could be any other suitable gas, such as pure nitrogen or argon. Body protection padding includes shoulder-chest pads, knee pads, hip pads, thigh pads and any other type of sports protective padding. The gas cells in the inside and outside gas cell impact layers do not burst upon impact. The at least one base shell is typically used in the body protection padding. Each gas cell layer includes a plurality of gas cells created between two plastic sheets. The inside and outside gas cell impact layers may be permanently or removably attached.

14 Claims, 17 Drawing Sheets

(56) References Cited

U.S. PATENT DOCUMENTS

| | | | | |
|---|---|---|---|---|
| 5,893,175 | A * | 4/1999 | Cooper | A41D 13/0155 2/462 |
| 6,035,453 | A * | 3/2000 | Cain | A41D 13/015 2/102 |
| 6,131,196 | A | 10/2000 | Vallion | |
| 6,681,403 | B2 | 1/2004 | Lyden | |
| 6,709,062 | B2 | 3/2004 | Shah | |
| 2006/0059609 | A1 | 3/2006 | Moss | |

* cited by examiner

BODY PROTECTIVE PADDING WITH NON-BURSTING GAS CELLS

CROSS-REFERENCES TO RELATED APPLICATIONS

This is a continuation-in-part application taking priority from patent application Ser. No. 14/588,998 filed on Jan. 5, 2015, which claims the benefit of patent application Ser. No. 14/337,582 filed on Jul. 22, 2014, which claims the benefit of provisional application No. 61/962,916 filed on Nov. 13, 2013 and provisional application No. 61/967,291 filed On Mar. 10, 2014.

BACKGROUND OF THE INVENTION

1. Field of the Invention

The present invention relates generally to body protection padding and more specifically to body protection padding with non-bursting air cells, which includes at least one air cell impact layer applied to at least an outside of a base shell.

2. Discussion of the Prior Art

The purpose of protective helmets is to prevent head injury incurred during some event, such as football, ice hockey, horseback riding, skiing, lacrosse, baseball, riding a motorcycle, construction and military combat. Helmets were first invented for protection in military engagements, and as such, started as protection from hand held weapons and evolved in the $20^{th}$ Century to protect from projectiles and explosives. As such, rigid, impenetrable helmets have been the paradigm we have used for the prevention of head injuries.

Rigid helmets have been partially successful at preventing injuries. However, the recent epidemic of concussions and the increasing awareness of the cumulative problems associated with repeated head trauma have unpacked the limitations of the current structure of protective helmets in all sports. Indeed, the same limitation could be claimed for all protective helmets including construction and military helmets.

The physics of head injury is all focused on the distance over which deceleration occurs. The human brain is very fragile, being composed of cells wrapped in membranes made of fluid fatty acids. Several trillion synapses in the brain are delicately poised in proximity to one another, without rigid and strong connections. These synapses are the functional means by which the brain operates. Shaking them disrupts them. The human nervous system has developed a host of strategies to enshrine the delicate neurons and their even more delicate synapse in a protective cocoon of safety. First and foremost, the brain is floating in water (otherwise called the cerebral spinal fluid), creating a bath without rigid inflexible supports. Within that water, the brain is suspended in a delicate spider web of suspending fibers and membranes that keep water from moving too quickly around the surface and allowing the soft brain to be gently suspended within the bony structure of the skull. The skull provides a rigid structure to contain the floating bath of fluid. Of note, the skull can be cracked and shattered as one strategy of dissipating force. This may lead to survival with subsequent healing. It is a unique and delicate bony structure around the brain, not seen anywhere else in the human body. The scalp provides an additional layer of safety. It is mobile and gives when struck, providing a few extra millimeters of deceleration distance. The scalp uniquely tears when stressed by direct blows, creating yet another mechanism of safety. The tearing creates large and dramatic scalp wounds in direct head trauma, but the brain underneath survives. Finally, the human skull is surrounded by hair, which can provide another layer of cushioning.

What are the physics of deceleration injury? The formula is simple: ΔVelocity/time=Deceleration. The change in velocity is divided by time. Rigid structures striking each other have a spike of deceleration within the first 0.00001 seconds. The more rigid and brittle, the higher the G-force generated for a shorter fragment of time. The Holy Grail of injury prevention in deceleration injury is to increase the distance and therefore time during which deceleration occurs. We are familiar with automobiles and have seen the effectiveness of airbags that increase the distance of deceleration of the human torso before it strikes the steering wheel. Vehicles are also designed to crumple so that force is taken up by bending metal, collapsing frames, shattering fenders, stretching seatbelts all of which increase the distance and time over which the human inside decelerates. Each of these strategies also complements the others to have a net effect of human survival, lowing the G forces from sufficient to break bones to simple sprains, strains and bruises.

Protective helmets have, to date, failed to provide a complete cocoon of safety. If the analogy to the human head can be used, protective helmets provide a skull and the inner dura, but there is no outer layer of safety. There is no scalp. No hair. Some advances have been made with the use of external foam with the SG Helmet. The missing ingredient in foam is that it fails to "fail". The human scalp tears and gives way. Foam doesn't tear. It does provide distance for greater deceleration, resulting in reduction of concussion injuries.

The value of air bubbles is that they easily deform, have little weight, stretch, deform rapidly with increasing resistance and, in extreme circumstances, burst. Bursting is a critical component, as it allows for the dissipation of force and then allows distance to increase as the next layer of bubbles can absorb the evolving contact. However, the essential stretching and increasing air pressure upon contact makes for a gradient of deceleration, which will provide protection. Foam deforms but is not as fluid as air bubbles, has greater weight, which may result in rotational injuries of the neck. The foam cannot burst thereby dissipating energy.

U.S. Pat. No. 3,872,511 to Nichols discloses protective headgear. U.S. Pat. No. 3,999,220 to Keltner discloses air cushioned protective gear. U.S. Pat. No. 4,586,200 to Poon discloses a protective crash helmet. U.S. Pat. No. 5,129,107 discloses an inflatable safety helmet specially for motorcycling. U.S. Pat. No. 5,263,203 to Kraemer et al. discloses an integrated pump mechanism and inflatable liner for protective. U.S. Pat. No. 5,669,079 to Morgan discloses a safety enhanced motorcycle helmet. U.S. Pat. No. 6,709,062 to Shah discloses a head restraint for a passenger of a vehicle.

The use of layers with air bubbles or air cells may be used for body protection padding, such as shoulder-chest pads, knee pads, hip pads, thigh pads and any other type of body protection padding. U.S. Pat. No. 4,287,250 to Rudy discloses elastomeric cushioning devices for products and objects. U.S. Pat. No. 6,131,196 to Vallion discloses an air capsule cushion padding member for protective joint and safety pads. U.S. Pat. No. 6,681,403 to Lyden discloses a shin-guard, helmet, and articles of protective equipment including light cure material. Patent publication no. 2006/0059609 to Moss discloses a self-adhesive protective padding device.

Accordingly, there is a clearly felt need in the art for body protection padding with non-bursting gas cells, which includes at least one gas cell layer applied to at least an outside of a base shell.

SUMMARY OF THE INVENTION

The present invention provides a soft helmet having blunt force trauma protection, which includes an air bubble impact layer. The soft helmet is suitable for cycling and medical helmet applications. The medical helmet applications include adults with uncontrolled seizure disorder, children who have repetitive head banging behavior, post neurosurgical interventions requiring skull protection or any other brain endangering behavior that requires a protective helmet.

The soft helmet having blunt force trauma protection (soft helmet) includes a hard shell member, at least one air bubble impact layer and a removable retention strap. The hard shell member is shaped or formed to fit on a top of a human head. The hard shell member is preferably fabricated from a flexible sheet of synthetic fiber material, such as Kevlar, but other materials may also be used. The inner and outer air bubble impact layers include a plurality of air filled bubbles, which do not burst upon impact. The plurality of bubbles are created between two flexible sheets of material. Each bubble retains the air therein and does not pass it to an adjacent bubble. Each bubble preferably includes a substantially elliptical shape in a horizontal plane and a substantially half elliptical shape in a vertical plane for increasing aerodynamics. The at least one air bubble impact layer is permanently attached to the hard shell member with adhesive or any other suitable substance or method. Ventilation openings are preferably formed between adjacent bubbles and through the at least one impact layer and the base member. The removable retention strap is preferably secured to opposing sides of a bottom of the hard shell member with sewing or any other suitable method. Retention straps are well known in the art and need not be explained in detail.

A second embodiment of a soft helmet includes the hard shell member, at least two air bubble impact layers and a removable retention strap. The hard shell member is shaped or formed to fit on a top of a human head. The at least one air bubble impact layer includes a plurality of small air filled bubbles, which do not burst upon impact. The plurality of bubbles are created between two flexible sheets of material. Each small bubble retains the air therein and does not pass it to an adjacent bubble. Each small bubble preferably includes a substantially round shape in a horizontal plane. A first air bubble impact layer is permanently attached to the hard shell member with adhesive or any other suitable substance or method. A second air bubble impact layer is permanently attached to a top of the first air bubble impact layer with adhesive or any other suitable method. Ventilation openings are preferably formed between adjacent bubbles and through the at least two air bubble impact layers and the base member. The removable retention strap is preferably secured to opposing sides of the bottom of the hard shell member with sewing or any other suitable method.

Body protection padding with non-bursting gas cells (body protection padding) preferably includes at least one base shell, an inside gas cell impact layer and an outside gas cell impact layer. The gas is preferably air, but could be any other suitable gas, such as pure nitrogen or argon. Body protection padding includes shoulder-chest pads, knee pads, hip pads, thigh pads and any other type of sports protective padding. The gas cells in the inside and outside gas cell impact layers do not burst upon impact. The at least one base shell is typically used in the body protection padding. The outside gas cell impact layer preferably includes at least one gas cell layer and an outside layer of sheet material. Each gas cell layer includes a plurality of gas cells created between two plastic sheets. The gas is not transferred between the plurality of gas cells. The plurality of gas cells preferably have a hexagon shape, but other shapes may also be used, such as round or square. The inside gas cell impact layer includes the at least one gas cell layer. However, the inside gas cell impact layer may be replaced with foam or any other padding known in the art. The outside gas cell impact layer may be permanently or removably attached to an outside surface of the base helmet shell. The inside gas cell impact layer may be permanently or removably attached to an inside surface of the base shell.

The shoulder-chest protective padding preferably includes a left chest shell, a right chest shell, a left shoulder shell, a right shoulder shell, a left tricep shell, a right tricep shell, a fabric vest, a securing strap and a plurality of inner gas cell layers and a plurality of outer gas cell layers. The left chest shell and the right chest shell are attached to a front of the fabric vest. The left shoulder shell is attached to a left shoulder portion of the fabric vest. The right shoulder shell is attached to a right shoulder portion of the fabric vest. The left tricep shell extends from a bottom of the left shoulder shell and the right tricep shell extends from a bottom of the right shoulder shell. At least one inside left chest gas cell layer is retained behind the left chest shell and concentric therewith. The at least one outside left chest gas cell layer is attached to an outer surface of the left chest shell. At least one inside right chest gas cell layer is retained behind the right chest shell and concentric therewith. The at least one outside right chest gas cell layer is attached to a front of the right chest shell. At least one inside left tricep gas cell layer is attached to an inside surface of the left tricep shell. At least one inside right tricep gas cell layer is attached to an inside surface of the right tricep shell. At least one outside left shoulder gas cell layer is attached to an outside surface of the left shoulder shell. At least one outside right shoulder gas cell layer is attached to an outside surface of the right shoulder shell.

The hip protective padding preferably includes a fabric brief, a left base shell, a right base shell, at least one left inside gas cell layer, at least one left outside gas cell layer, at least one right inside gas cell layer and at least one right outside gas cell layer. The fabric brief may be fabricated from any suitable material, such as Spandex. The left base shell is attached to a left side of the fabric brief. The at least one left outside gas cell layer is attached to an outside surface of the left base shell. The at least one left inside gas cell layer is retained behind the left base shell and concentric therewith.

The right base shell is attached to a right side of the fabric brief. The at least one right outside gas cell layer is attached to an outside surface of the right base shell. The at least one right inside gas cell layer is retained behind the right base shell and concentric therewith. However, the inside gas cell impact layer may be replaced with foam or any other padding known in the art.

The knee protective padding preferably includes a knee base shell, a base material, at least one securement strap, at least one inside gas cell layer and at least one outside gas cell layer. The knee base shell is attached to the fabric base material. The at least one securement strap is attached to the base material. The at least one inside gas cell layer is retained behind the knee base shell and concentric therewith.

However, the inside gas cell impact layer may be replaced with foam or any other padding known in the art. The at least one outside gas cell layer is attached to an outside surface of the knee base shell. The at least one securment strap is tightened to ensure that the knee base shell stays positioned over a knee.

The thigh protective padding preferably includes a base material, a thigh base shell, at least one securement strap, at least one inside gas cell layer and at least one outside gas cell layer. The thigh base shell is attached to the base material. The at least one outside gas cell layer is attached to an outside surface of the thigh base shell. The at least one inside gas cell layer is retained behind the thigh base shell and concentric therewith. However, the inside gas cell impact layer may be replaced with foam or any other padding known in the art. At least one securement strap is attached to the base material. The at least one securment strap is tightened to ensure that the thigh base shell stays positioned on a thigh.

Accordingly, it is an object of the present invention to provide a soft helmet, which includes at least one air bubble impact layer having a plurality of elliptical bubbles mounted to a flexible base member.

It is another object of the present invention to provide a soft helmet, which includes at least two air bubble impact layer having a plurality of small bubbles mounted to a flexible base member.

It is a further object of the present invention to provide a soft helmet, which includes an air bubble impact layer disposed on an outside surface of the helmet.

It is yet a further object of the present invention to provide a helmet having non-bursting air cells, which includes inside and outside air cell impact layers located on inside and outside surface of a base helmet shell.

It is yet a further object of the present invention to provide a helmet having non-bursting air cells, which includes an inside air cell inflatable impact layer and an outside air cell impact layer located on inside and outside surfaces of the helmet.

Finally, it is an object of the present invention to provide body protection padding with non-burtsing gas cells, which can be applied to shoulder-chest pads, knee pads, hip pads and thigh pads.

These and additional objects, advantages, features and benefits of the present invention will become apparent from the following specification.

DETAILED DESCRIPTION OF THE PREFERRED EMBODIMENTS

Figure 1:
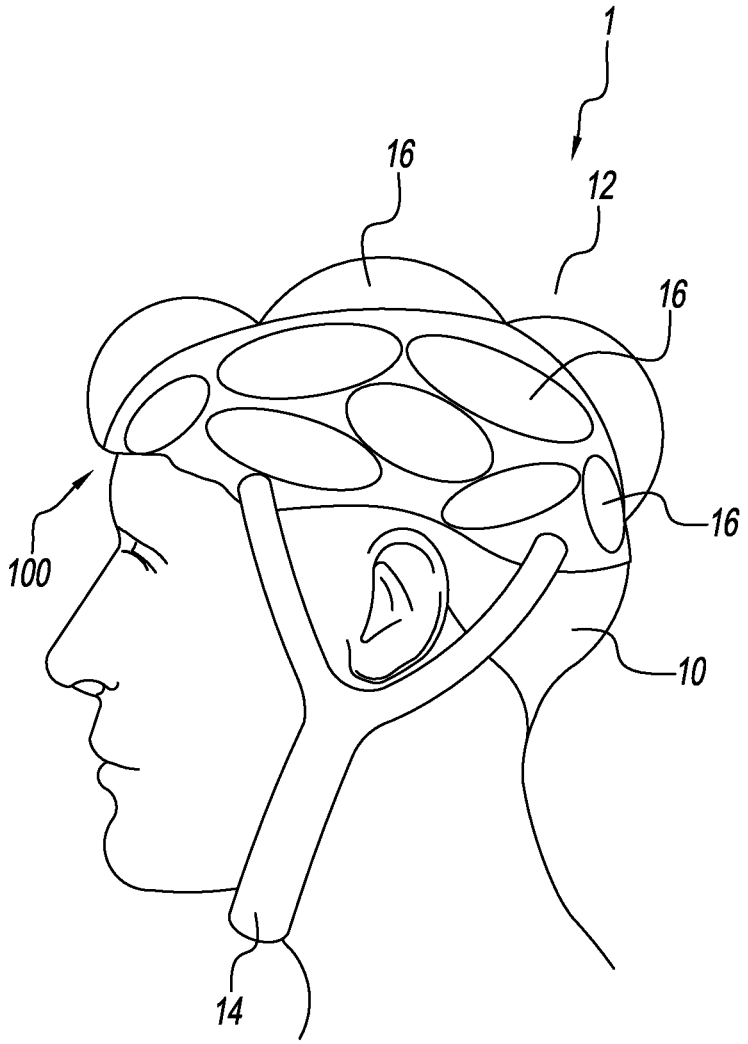
FIG. 1 is a side view of a user wearing a soft helmet in accordance with the present invention.
Figure 2:
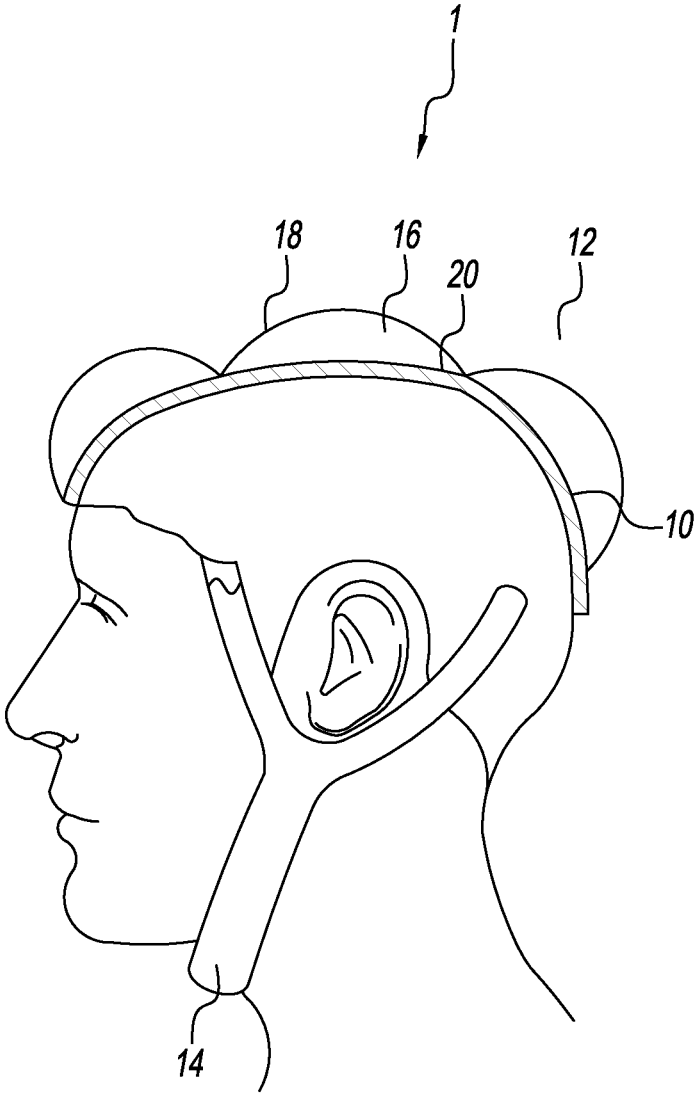
FIG. 2 is a side cross sectional view of a user wearing a soft helmet in accordance with the present invention.

With reference now to the drawings, and particularly to FIG. 1, there is shown a side view of a user wearing a soft helmet 1. The soft helmet 1 includes a hard shell member 10, at least one air bubble impact layer 12 and a retention strap 14. The hard shell member 10 is shaped or formed to fit on a top of a human head 100. The hard shell member 10 is fabricated from a flexible sheet of synthetic fiber material, such as Kevlar. The at least one air bubble impact layer 12 includes a plurality of air filled bubbles 16, which do not burst upon impact. The plurality of bubbles 16 are created between two flexible sheets of material 18, 20. Each bubble 16 retains the air therein and does not pass it to an adjacent bubble 16. Each bubble 16 preferably includes a substantially elliptical shape in a horizontal plane and a substantially half elliptical shape in a vertical plane for increasing aerodynamics.

Figure 3:
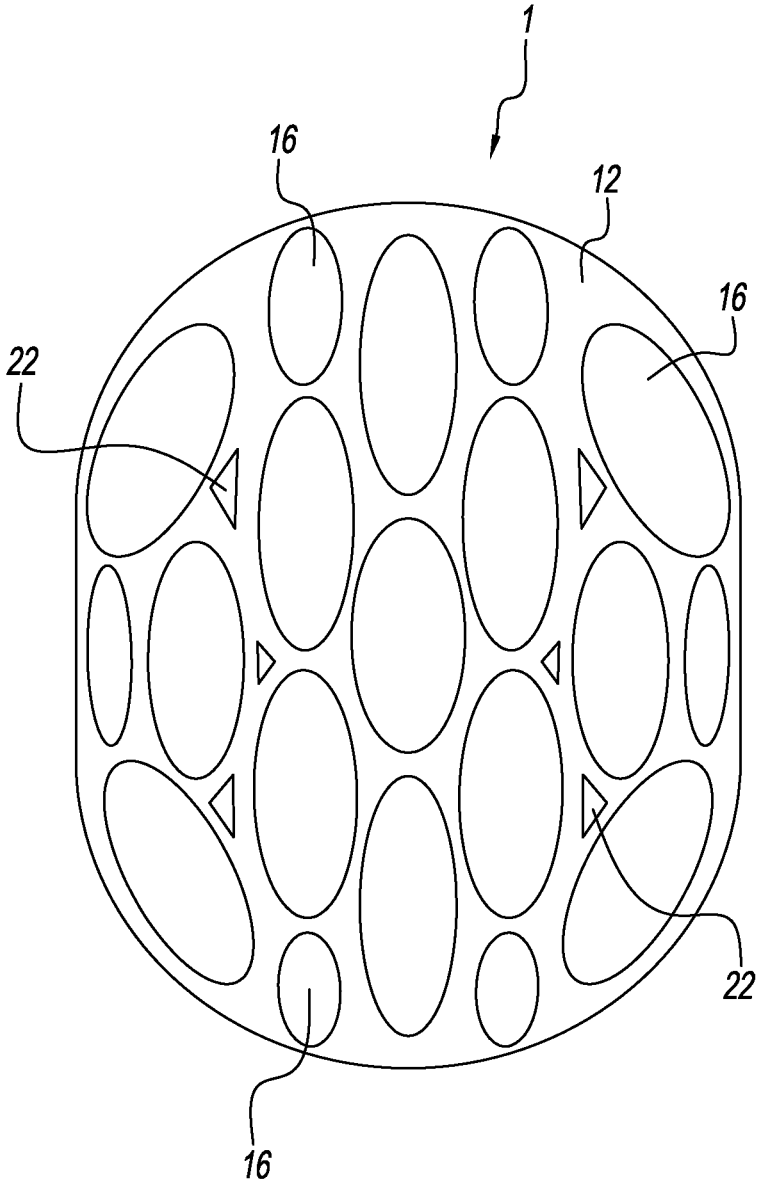
FIG. 3 is a top view of a soft helmet in accordance with the present invention.
Figure 4:
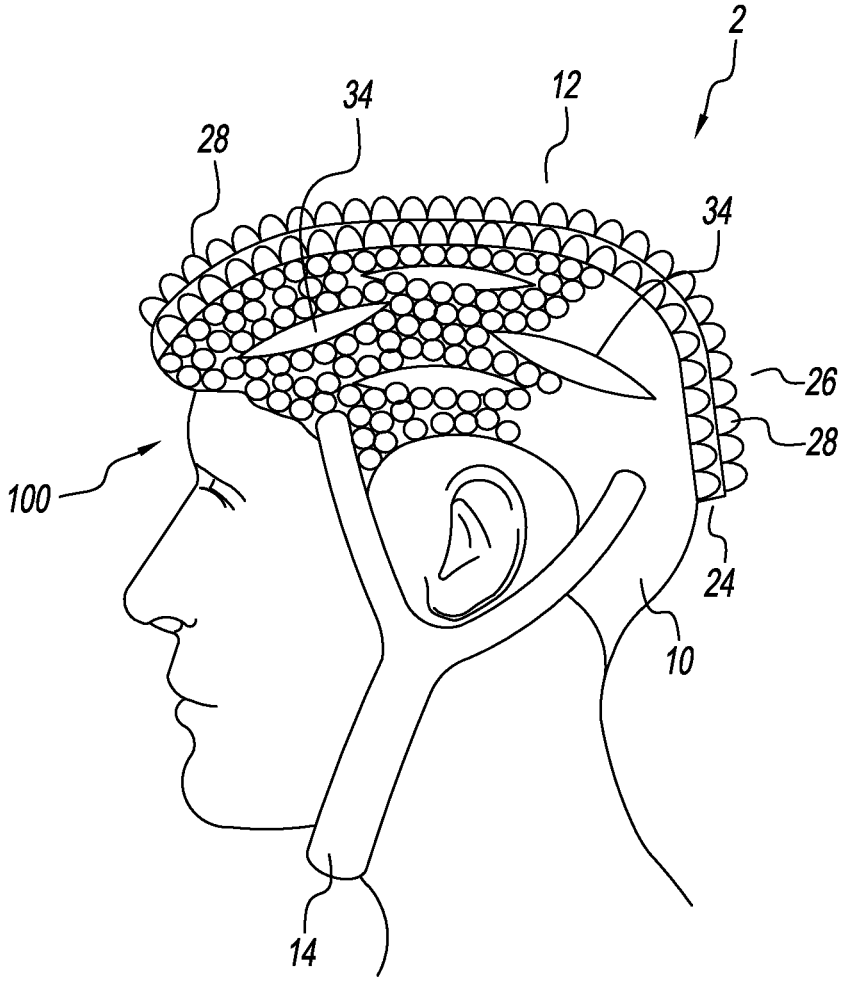
FIG. 4 is a side view of a second embodiment of a soft helmet in accordance with the present invention.
Figure 5:
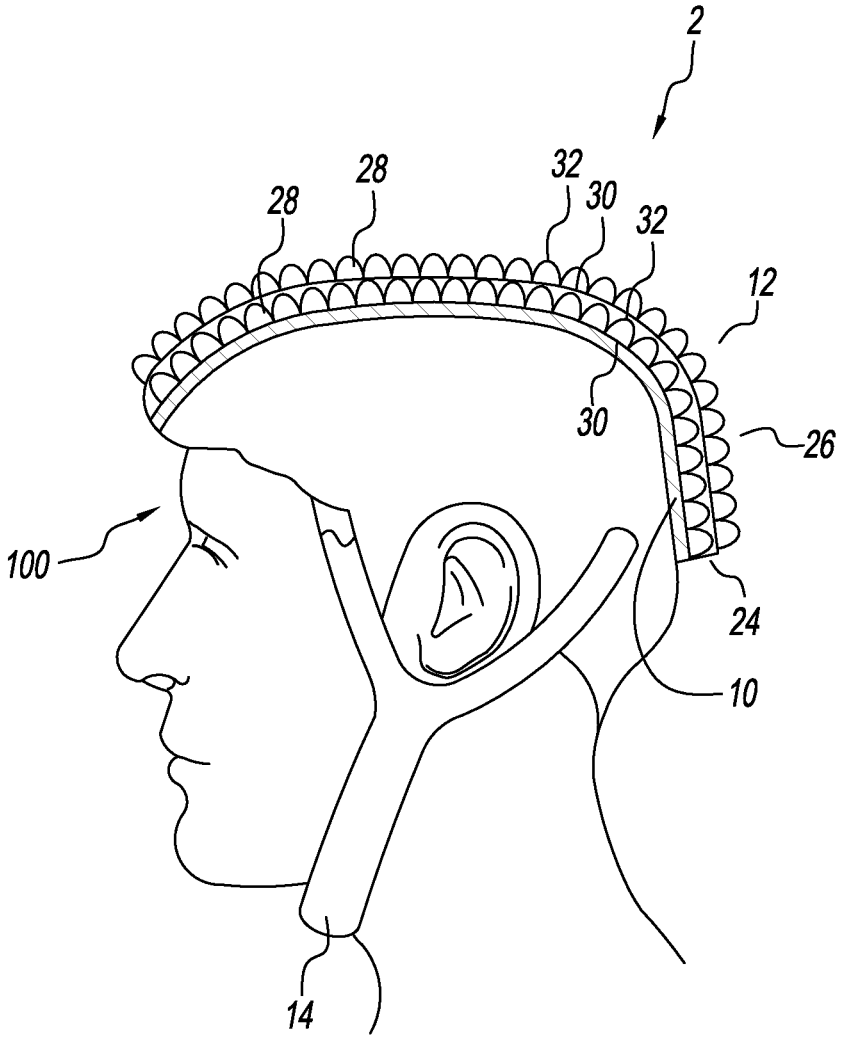
FIG. 5 is a side cross sectional view of a second embodiment of a soft helmet in accordance with the present invention.
Figure 6:
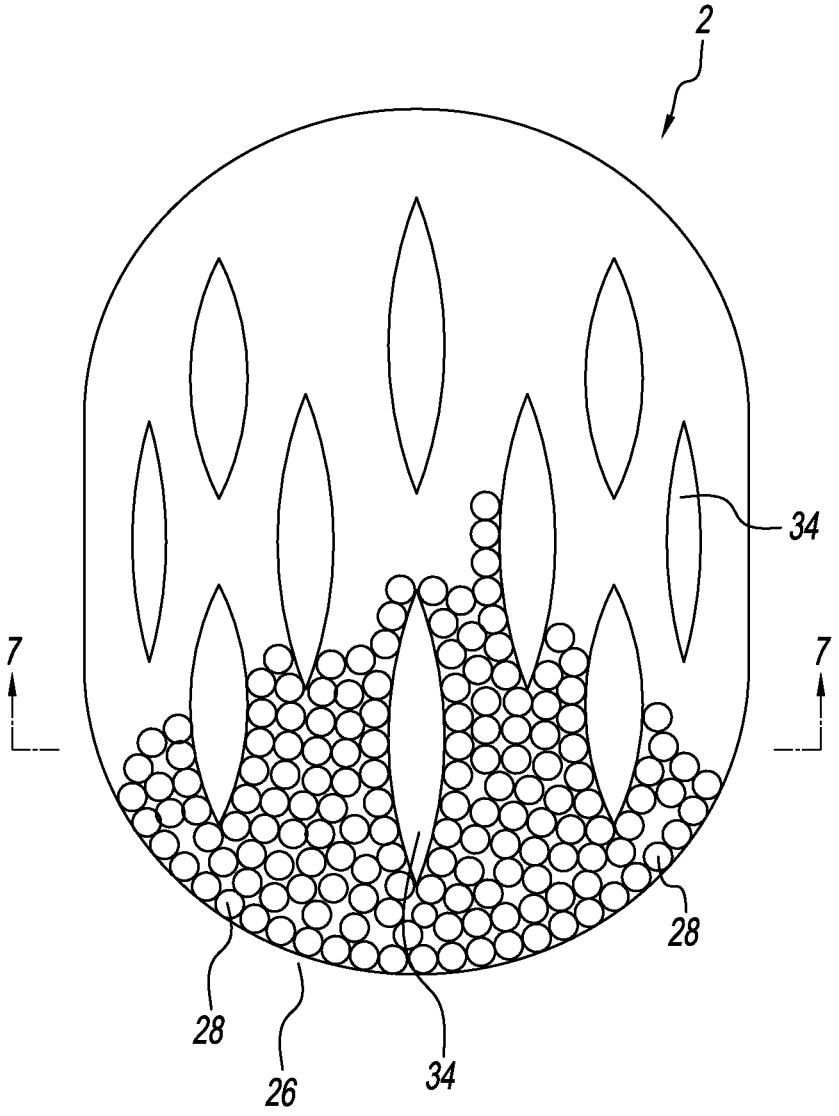
FIG. 6 is a top view of a second embodiment of a soft helmet in accordance with the present
Figure 7:
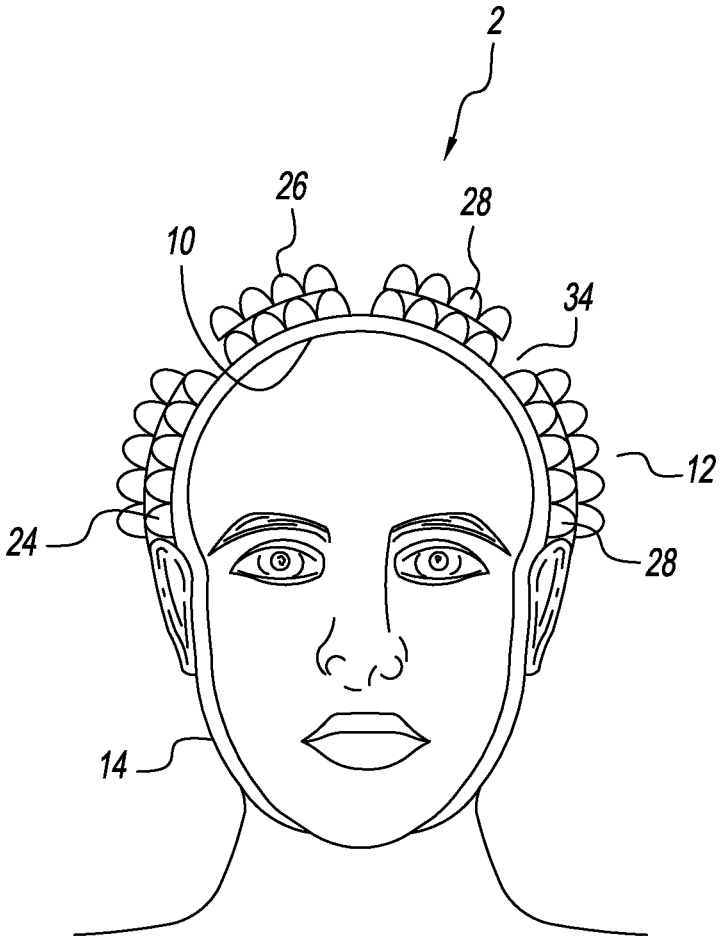
FIG. 7 is a front cross sectional view cut through FIG. 6 of a second embodiment of a soft helmet in accordance with the present.

The plurality of bubbles 16 may be different sizes to optimize nesting of the bubbles 16 on the impact layer 12. The at least one air bubble impact layer 12 is permanently attached to the hard shell member 10 with adhesive or any other suitable substance or method. With reference to FIG. 3, ventilation openings 22 are preferably formed through the impact layer 12 and the hard shell member 10. The retention strap 14 is preferably secured to opposing sides of a bottom of the hard shell member 10 with sewing or any other suitable method. Retention straps are well known in the art and need not be explained in detail.

A second embodiment of a soft helmet 2 includes the hard shell member 10, at least two air bubble impact layers 24, 26 and the removable retention strap 14. The hard shell member 10 is shaped or formed to fit on the top of the human head 100. The at least two air bubble impact layers 24, 26 include a plurality of small air filled bubbles 28, which do not burst upon impact. The plurality of small bubbles 28 are created between two flexible sheets of material 30, 32. Each small bubble 28 retains the air therein and does not pass it to an adjacent bubble 28. Each small bubble 28 preferably includes a substantially round shape in a horizontal plane. The soft helmet 2 is suitable for cycling. The first impact layer 24 is permanently attached to the hard shell member 10 with adhesive or any other suitable substance or method. The second impact layer 26 is permanently attached to a top of the first impact layer 24 with adhesive or any other suitable method. Ventilation openings 34 are preferably formed through the at least two impact layers 24, 26 and the base member 10. The removable retention strap 14 is preferably secured to opposing sides of the bottom of the hard shell member 10 with sewing or any other suitable method.

Figure 8:
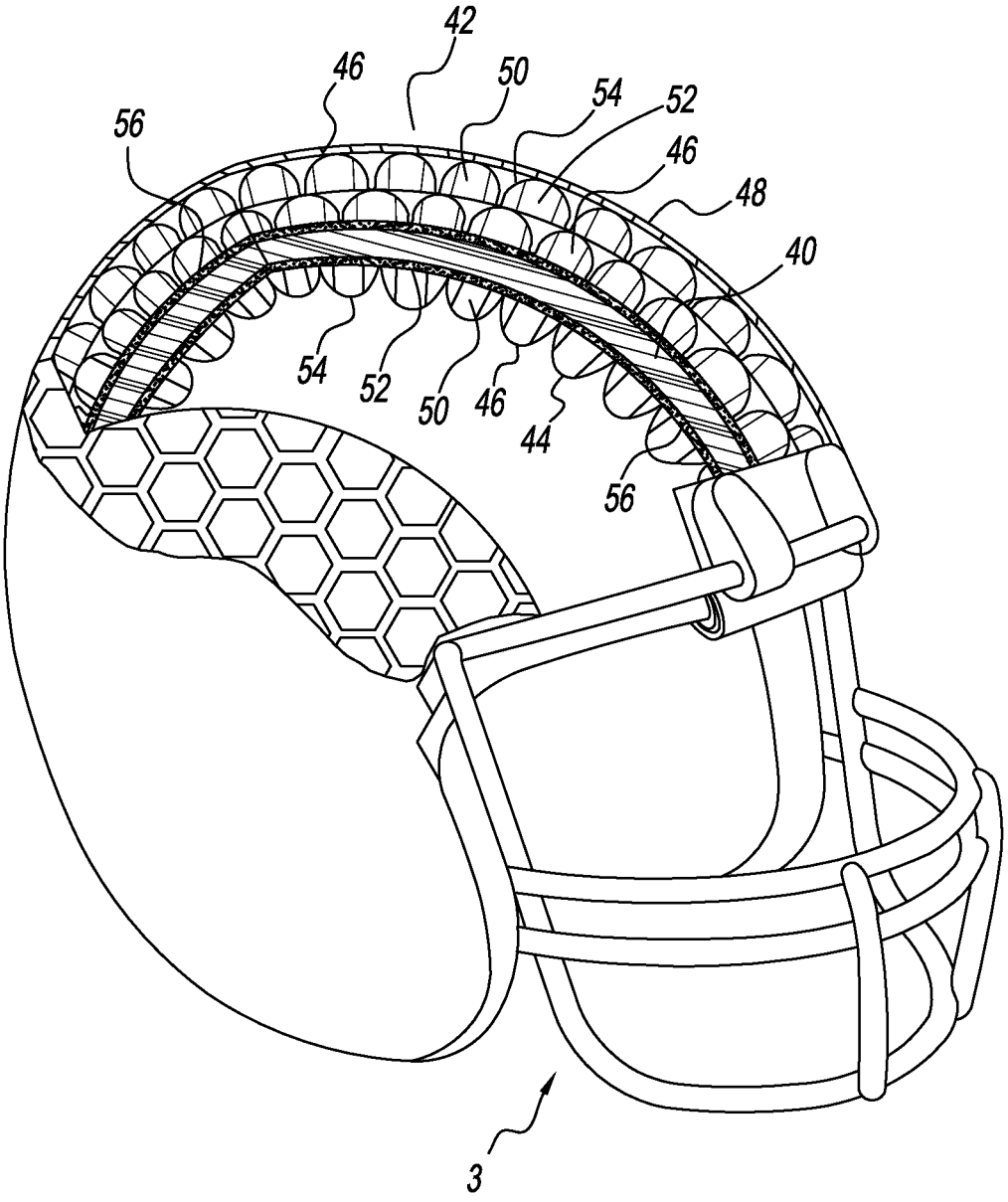
FIG. 8 is a perspective cut-away view of a helmet having non-bursting air cells with inside and outside air cell impact layers in accordance with the present invention.

With reference to FIG. 8, a helmet having non-bursting air cells 3 preferably includes a hard helmet shell 40, an outside air cell impact layer 42 and an inside air cell impact layer 44. The air cells 50 in the inside and outside air cell impact layers do not burst upon impact. The hard helmet shell 40 is any type of prior art helmet, such as a football helmet, a motorcycle helmet, a bicycle helmet, a baseball helmet, lacrosse helmet or any type of protective helmet for a human head. The outside air cell impact layer 42 preferably includes at least one air cell layer 46 and an outside layer of sheet material 48. Team identification may be printed on the outside layer of sheet material 48. The at least one air cell layer 46 includes a plurality of air cells 50 created by a base sheet 52 and a cell sheet 54. Air is not transferred between the plurality of air cells 50. The plurality of air cells 50 preferably have a hexagon shape, but other shapes may also be used, such as round or square.

The at least one air cell layer 46 may be permanently attached to an outside surface of the hard helmet shell 40 or removably attached with a removable attachment system 56. The removable attachment system 56 is preferably hook and loop fastening pads, but other suitable removable attachment systems may also be used. A second air cell layer 46 may be attached to a top of the air cell layer 46 with adhesive or any other suitable method. The outside layer of sheet material 48 is permanently attached to a top of the air cell layer 46 or the second air cell layer 46 with adhesive or any other suitable method. The inside air cell impact layer 44 includes the at least one air cell layer 46. The at least one air cell layer 46 may be permanently attached to an inside surface of the hard helmet shell 40 or removably attached with the removable attachment system 56.

Figure 9:
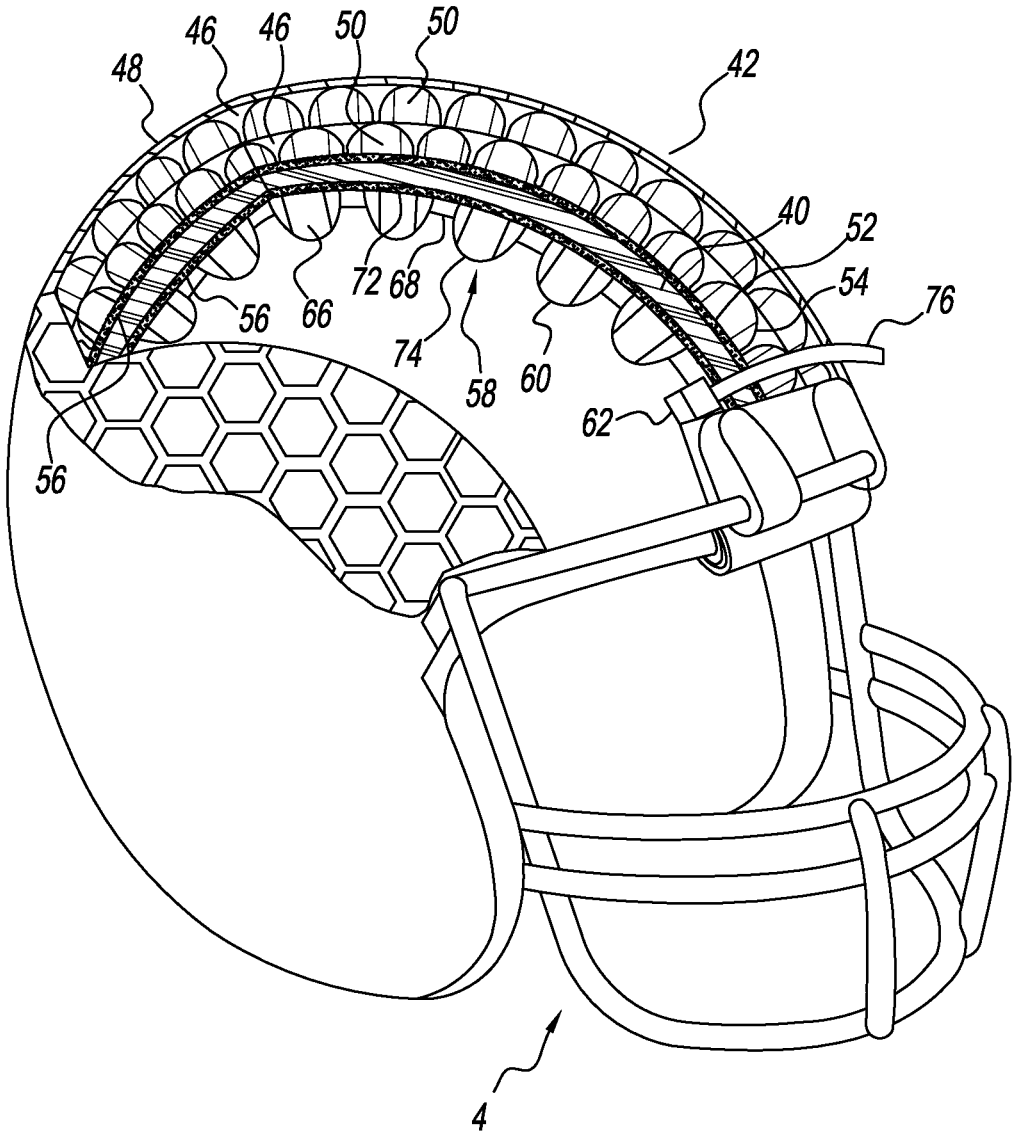
FIG. 9 is a perspective cut-away view of a helmet having non-bursting air cells with an inside air cell inflatable layer and an outside air cell impact layer in accordance with the present invention.

With reference to FIG. 9, a second embodiment of the helmet having non-bursting air cells 4 preferably includes the hard helmet shell 40, the outside air cell impact layer 42 an inside air cell inflatable impact layer 58. The air cells 50 in the inside and outside air cell impact layers do not burst upon impact. The outside air cell impact layer 42 preferably includes the at least one air cell layer 46 and the outside layer of sheet material 48. The outside air cell impact layer 42 may be permanently or removably attached to an outside surface of the hard helmet shell as previously described.

Figure 10:
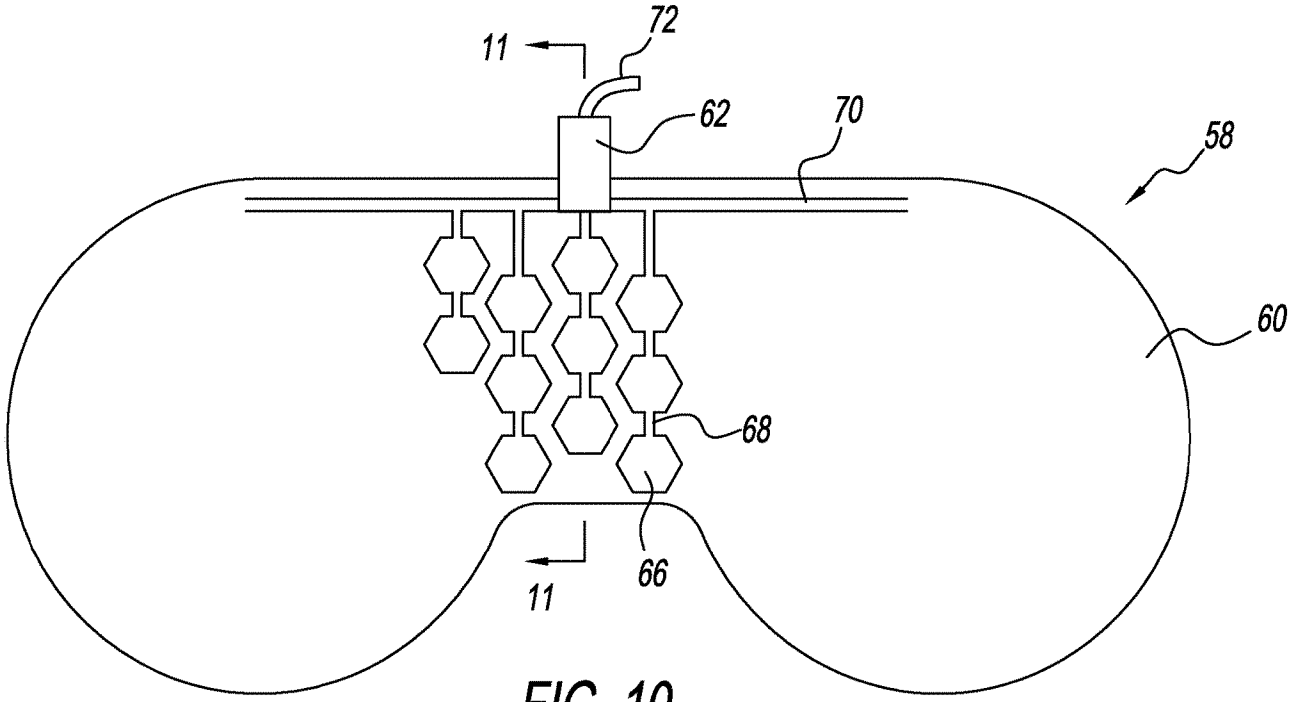
FIG. 10 is a top view of an inside air cell inflatable layer of a helmet having non-bursting air cells in accordance with the present invention.
Figure 11:
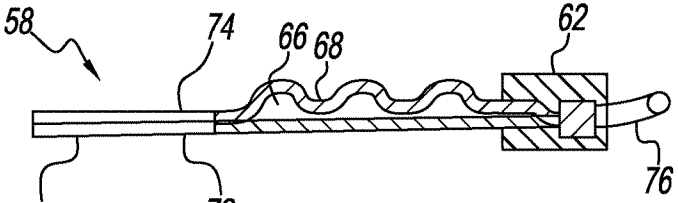
FIG. 11 is a cross sectional view of an inside air cell inflatable layer of a helmet having non-bursting air cells in accordance with the present invention.

With reference to FIGS. 10-11, the inside air cell inflatable layer 58 preferably includes at least one inflatable air cell layer 60 and a check valve 62. The outer perimeter of the inflatable air cell layer 60 is shaped to fit inside the hard helmet shell 40. A plurality of air cells 66, a plurality of air passages 68 and an air manifold 70 are preferably formed between a base sheet 72 and a cell sheet 74. Pressurized air flows into an entrance of the check valve 62 through the fill nozzle 76. The pressured air flows into the air fill manifold 70 through the check valve 62. The air fill manifold 70 distributes the pressurized air to the plurality of air passages 68 and the plurality of air cells 66. The inside air cell inflatable layer 58 may be permanently or removably attached to an inside surface of the hard helmet shell 40. The fill nozzle 76 of the check valve preferably extends past an outside surface of the helmet 40. Air pressure may be measured with an air pressure gage.

With reference to FIGS. 12-24, body protection padding with non-bursting gas cells (body protection padding) preferably includes at least one base shell, an inside gas cell impact layer and an outside gas cell impact layer. The gas is preferably air, but could be any other suitable gas, such as pure nitrogen or argon. Body protection padding includes shoulder-chest pads 80, hip pads 82, knee pads 84, thigh pads 86 and any other type of sports protective padding. The gas cells in the inside and outside gas cell impact layers do not burst upon impact. The at least one base shell is typically used in the body protection padding. However, the base shell does not have to be hard. The base shell could have some amount of resilience. The outside gas cell impact layer preferably includes at least one gas cell layer and an outside layer of sheet material. Each gas cell layer includes a plurality of gas cells created between two plastic sheets. The gas is not transferred between the plurality of gas cells. The plurality of gas cells preferably have a hexagon shape, but other shapes may also be used, such as round or square. The inside gas cell impact layer includes the at least one gas cell layer. However, the inside gas cell impact layer may be replaced with foam or any other padding known in the art. The outside gas cell impact layer may be permanently or removably attached to an outside surface of the base helmet shell. The inside gas cell impact layer may be permanently or removably attached to an inside surface of the base shell.

Figure 12:
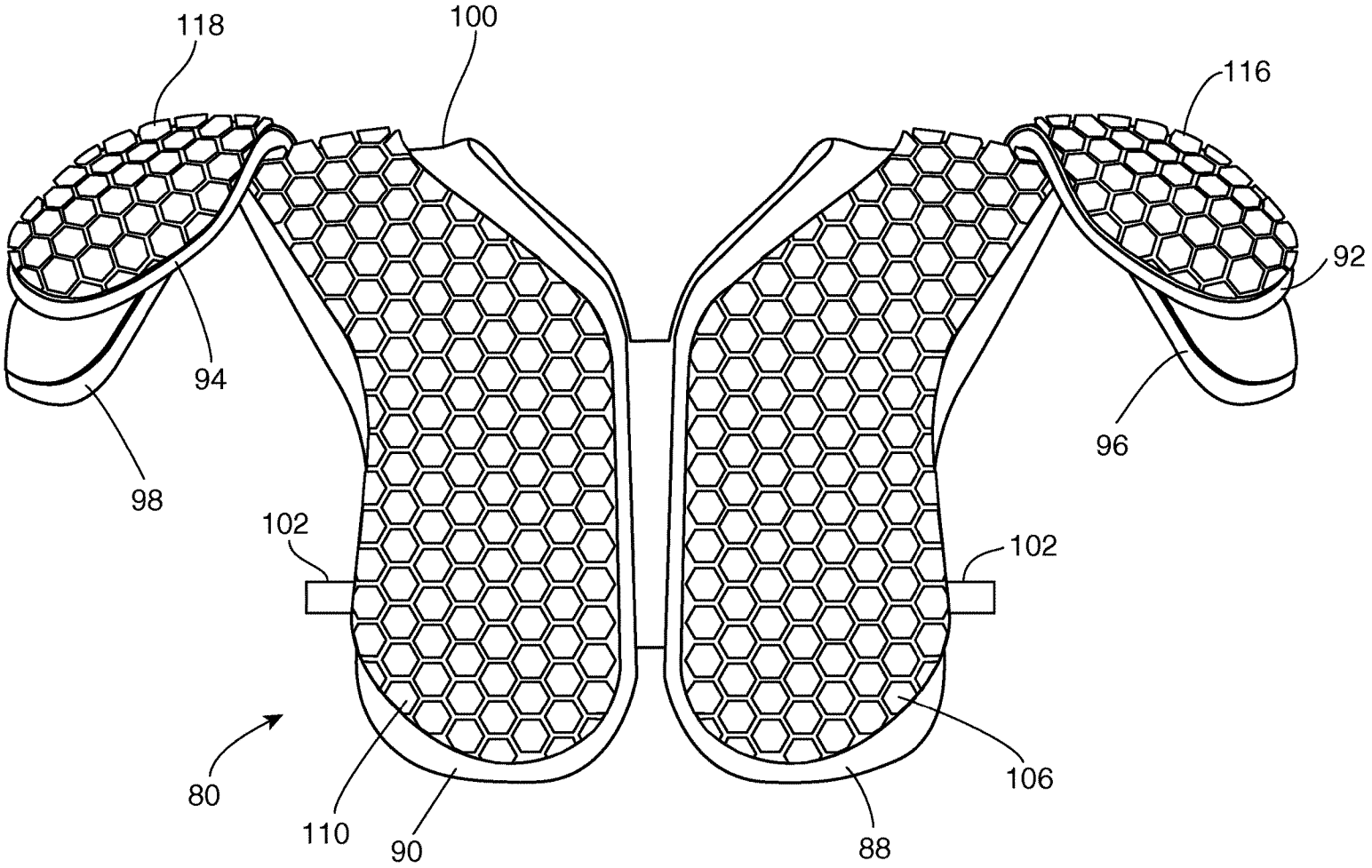
FIG. 12 is a front view of shoulder-chest protective padding having non-bursting gas cells in accordance with the present invention.
Figure 13:
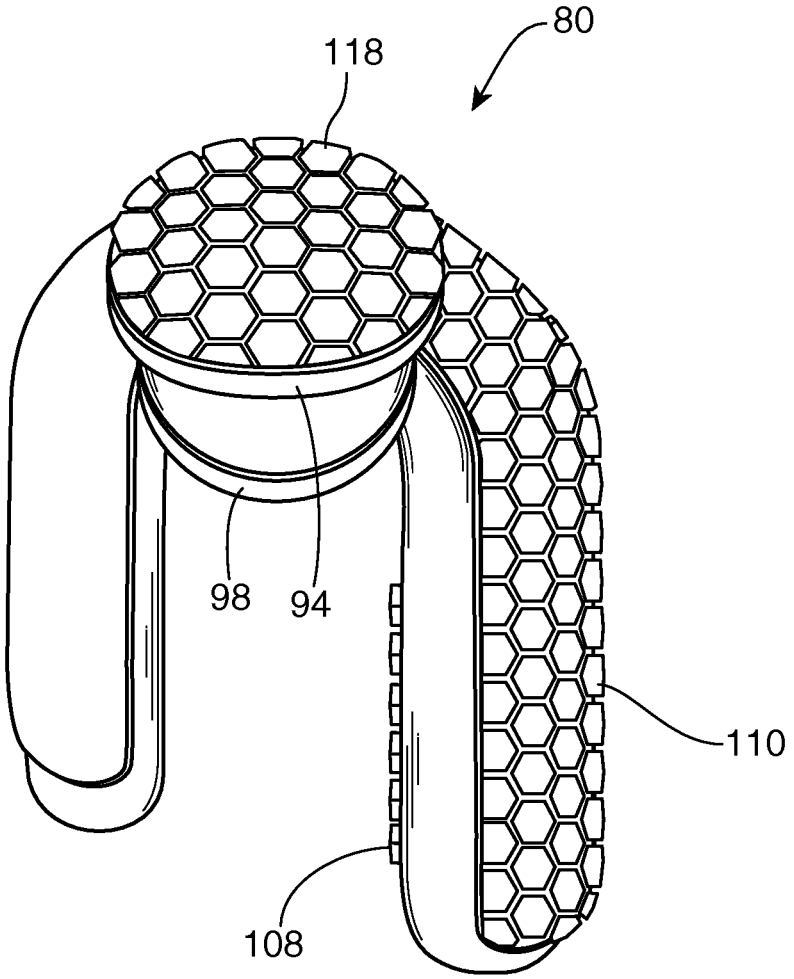
FIG. 13 is a side view of shoulder-chest protective padding having non-bursting gas cells in accordance with the present invention.
Figure 14:
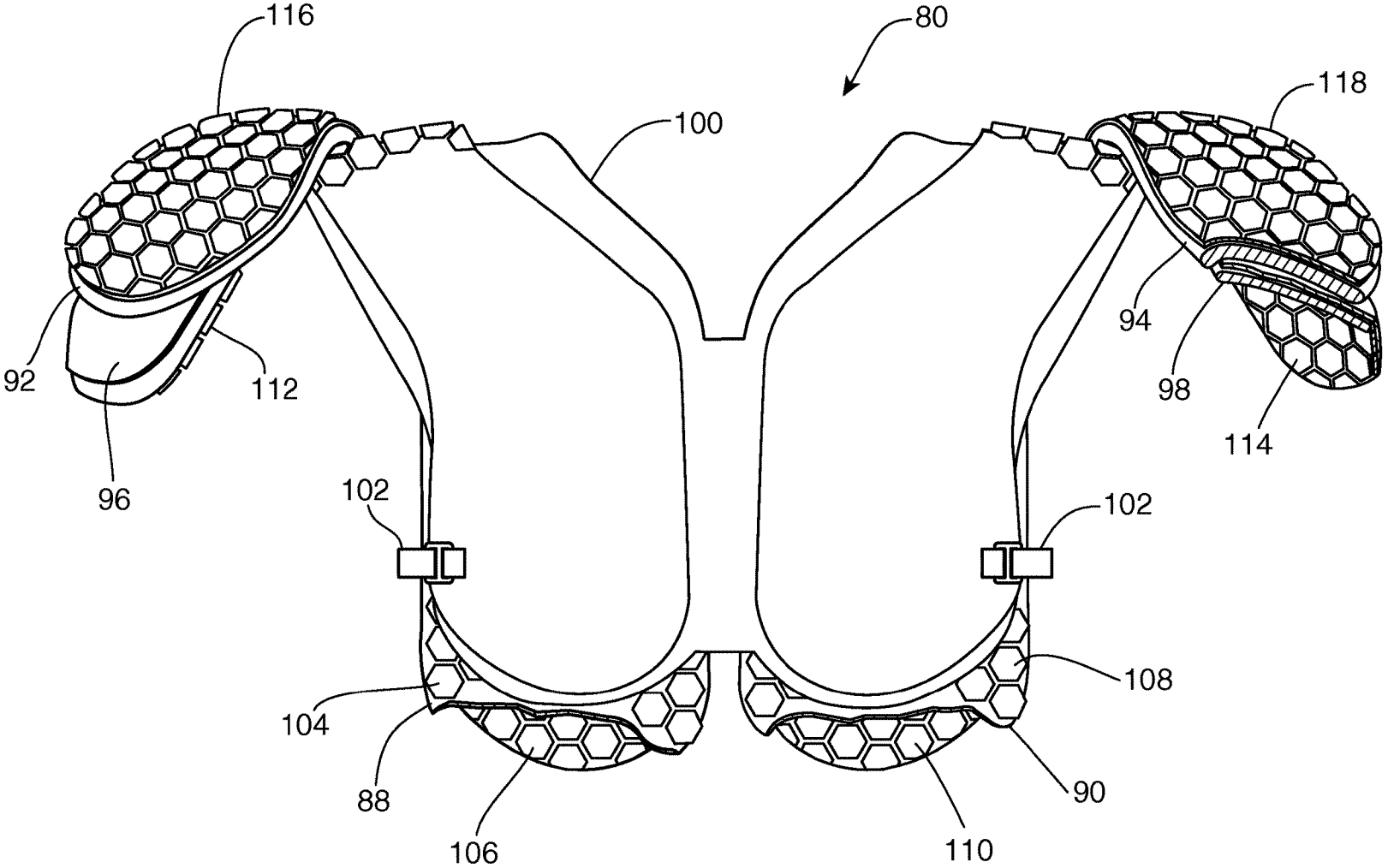
FIG. 14 is a rear view of shoulder-chest protective padding having non-bursting gas cells in accordance with the present invention.
Figure 15:
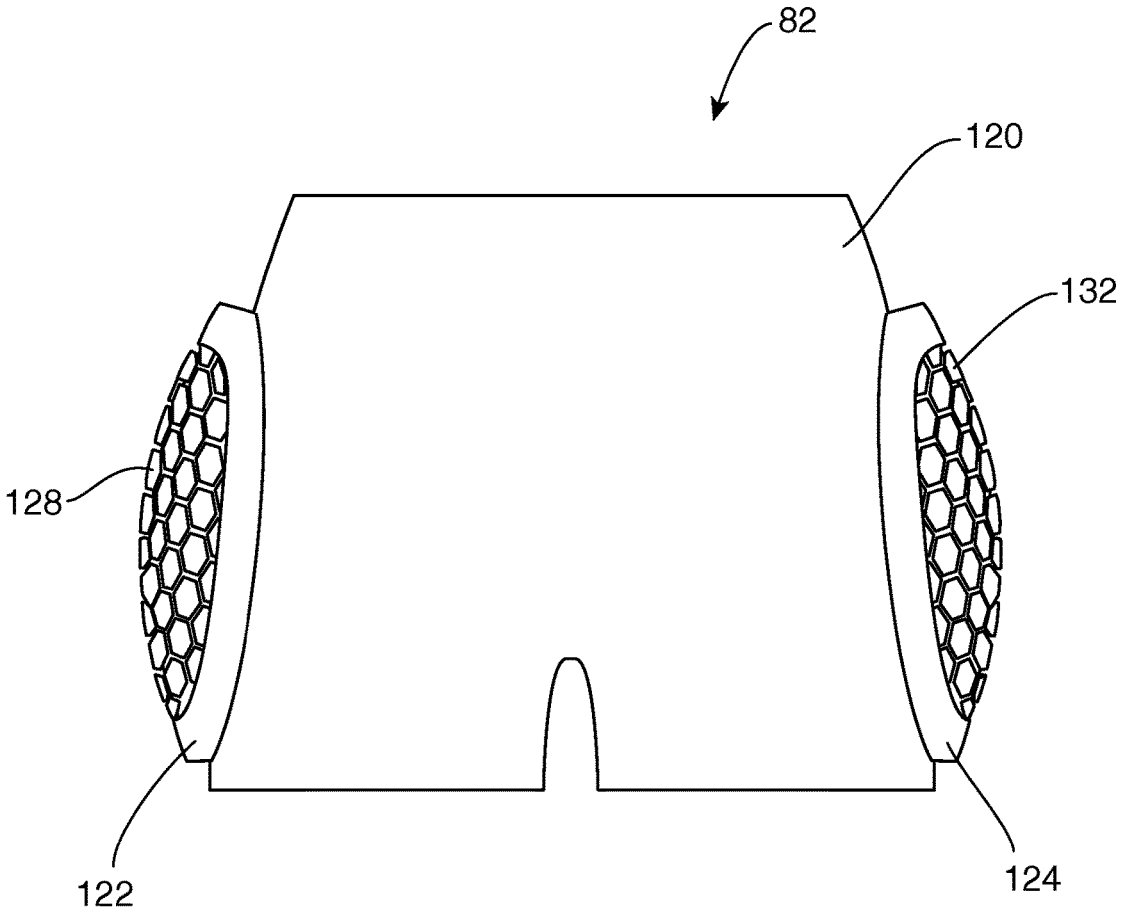
FIG. 15 is a rear view of hip protective padding having non-bursting gas cells in accordance with the present invention.
Figure 16:
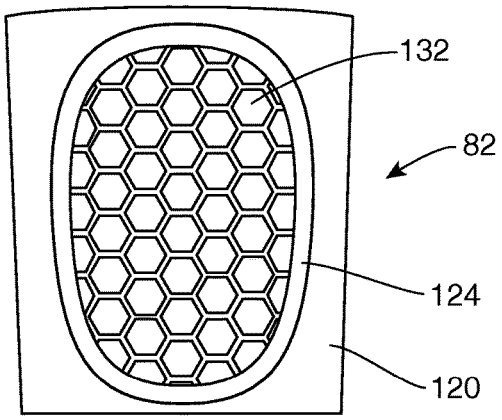
FIG. 16 is a side view of hip protective padding having non-bursting gas cells in accordance with the present invention.
Figure 17:
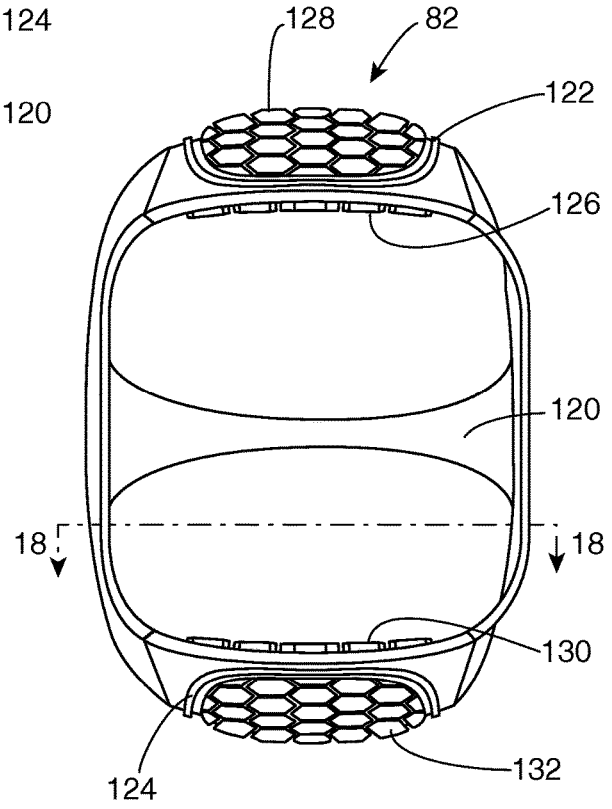
FIG. 17 is a top view of hip protective padding having non-bursting gas cells in accordance with the present invention.
Figure 18:
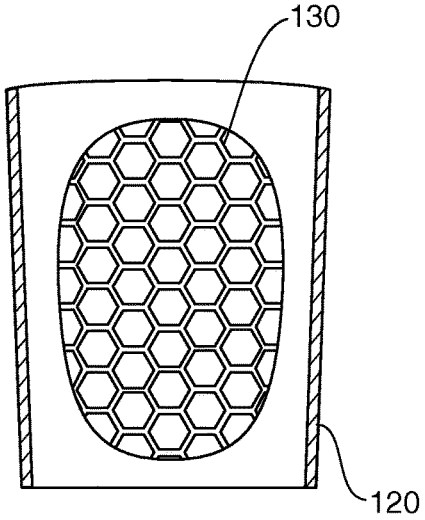
FIG. 18 is a cross sectional view of hip protective padding having non-bursting gas cells cut through FIG. 15 in accordance with the present invention.
Figure 19:
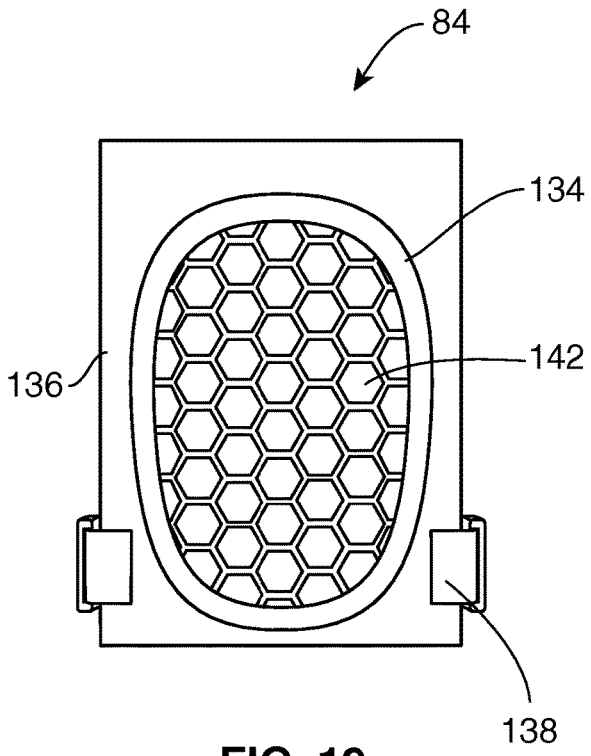
FIG. 19 is a front view of knee protective padding having non-bursting gas cells in accordance with the present invention.
Figure 21:
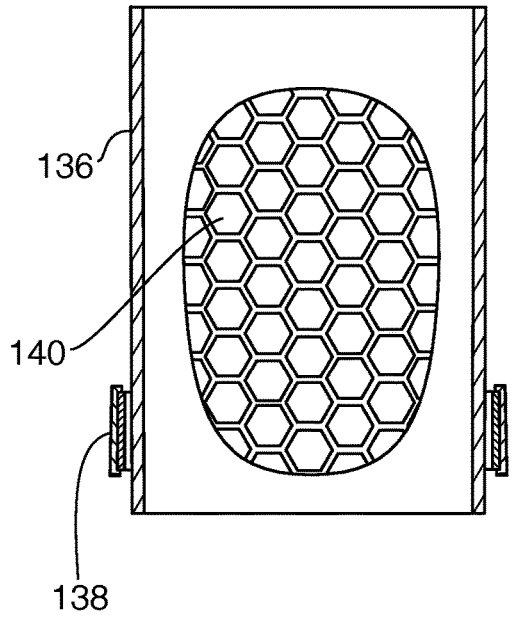
FIG. 21 is a cross sectional view of knee protective padding having non-bursting gas cells cut through FIG. 20 in accordance with the present invention.
Figure 20:
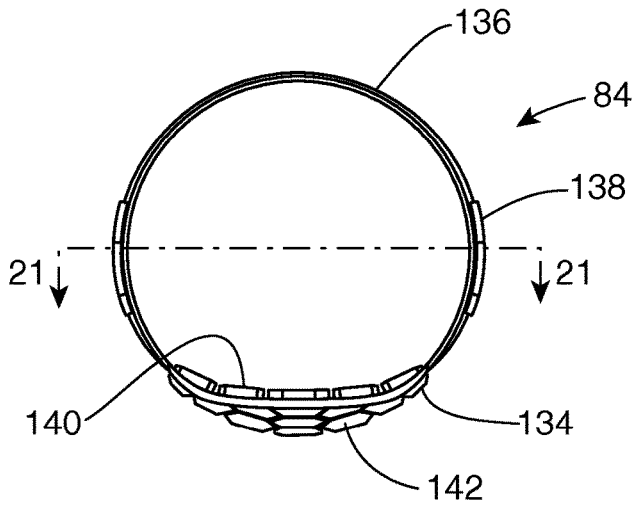
FIG. 20 is a top view of knee protective padding having non-bursting gas cells in accordance with the present invention.

With reference to FIGS. 12-14, the shoulder-chest protective padding 80 preferably includes a left chest shell 88, a right chest shell 90, a left shoulder shell 92, a right shoulder shell 94, a left tricep shell 96, a right tricep shell 98, a fabric vest 100, at least one securing strap 102 and a plurality of inner gas cell layers and a plurality of outer gas cell layers. The fabric vest 100 is sized to fit over the shoulder and chest of the user. The fabric vest may be fabricated from any suitable material known in the art. The left chest shell 88 and the right chest shell 90 are attached to a front of the fabric vest 100. The left shoulder shell 92 is attached to a left shoulder portion of the fabric vest 100. The right shoulder shell 94 is attached to a right shoulder portion of the fabric vest 100. The left tricep shell 96 extends from a bottom of the left shoulder shell 92 and the right tricep shell 98 extends from a bottom of the right shoulder shell 94.

At least one inside left chest gas cell layer 104 is retained behind the left chest shell 88 and concentric therewith. At least one outside left chest gas cell layer 106 is attached to an outside surface of the left chest shell 88. At least one inside right chest gas cell layer 108 is retained behind the right chest shell 90 and concentric therewith. However, the at least one inside left and right chest gas cell layers 104, 108 may be replaced with some other type of inside chest padding, such as foam. The at least one outside right chest gas cell layer 110 is attached to an outside surface of the right chest shell 90. At least one inside left tricep gas cell layer 112 is attached to an inside surface of the left tricep shell 96. At least one inside right tricep gas cell layer 114 is attached to an inside surface of the right tricep shell 98. At least one outside left shoulder gas cell layer 116 is attached to an outside surface of the left shoulder shell 92. At least one outside right shoulder gas cell layer 118 is attached to an outside surface of the right shoulder shell 94.

With reference to FIGS. 15-18, the hip protective padding 82 preferably includes a fabric brief 120, a left base shell 122, a right base shell 124, at least one left inside gas cell layer 126, at least one left outside gas cell layer 128, at least one right inside gas cell layer 130 and at least one right outside gas cell layer 132. The fabric brief 120 is sized to fit on a waist and legs of the user. The fabric brief 120 may be fabricated from any suitable material known in the art, such as Spandex. The left base shell 122 is attached to a left side of the fabric brief 120. The at least one left inside gas cell layer 126 is retained behind the left base shell 122 and concentric therewith. The at least one left outside gas cell layer 128 is attached to an outside surface of the left base shell 122. The right base shell 124 is attached to a right side of the fabric brief 120. The at least one right inside gas cell layer 130 is retained behind the right base shell 124 and concentric therewith. The at least one right outside gas cell layer 132 is attached to an outside surface of the right base shell 124. However, the at least one inside left and right gas cell layers 126, 130 may be replaced with some other type of inside chest padding, such as foam.

With reference to FIGS. 19-22, the knee protective padding 84 preferably includes a knee base shell 134, a base material 136, at least one securement strap 138, at least one inside gas cell layer 140 and at least one outside gas cell layer 142. The knee base shell 134 is attached to the base material 136. The base material 136 is retained on a knee and leg. The base material 136 may be any suitable material known in the art of athletic padding. The at least one securement strap 138 is attached to an outside surface of the base material 136. The at least one inside gas cell layer 140 is retained behind the knee base shell 134 and concentric therewith. However, the at least one inside gas cell layer 140 may be replaced with some other type of inside padding, such as foam. The at least one outside gas cell layer 142 is attached to an outside surface of the knee base shell 134. The at least one securment strap 138 is tightened to ensure that the base material 136 stays positioned over a knee.

Figure 22:
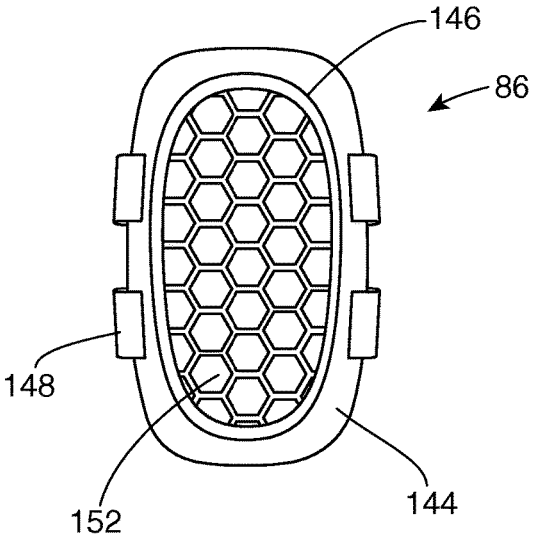
FIG. 22 is a front view of thigh protective padding having non-bursting gas cells in accordance with the present invention.
Figure 24:
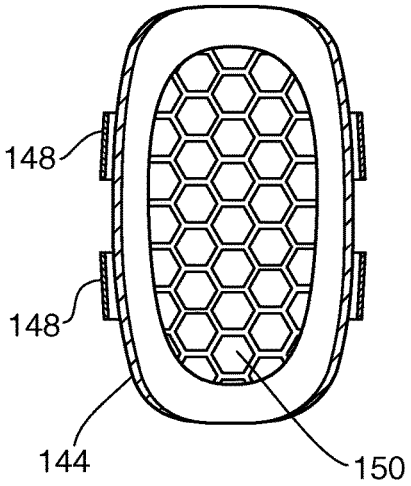
FIG. 24 is a cross sectional view of thigh protective padding having non-bursting gas cells cut through FIG. 20 in accordance with the present invention.
Figure 23:
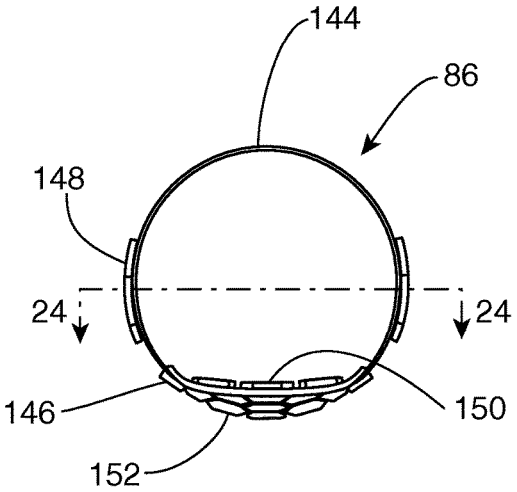
FIG. 23 is a top view of thigh protective padding having non-bursting gas cells in accordance with the present invention.

With reference to FIGS. 22-24, the thigh protective padding 86 preferably includes a base material 144, a thigh base shell 146, at least one securement strap 148, at least one inside gas cell layer 150 and at least one outside gas cell layer 152. The thigh base shell 146 is attached to the base material 144. The base material 136 is retained on a thigh and may be any suitable material known in the art of athletic padding. The at least one inside gas cell layer 150 is retained behind the thigh base shell 146 and concentric therewith. However, the at least one inside gas cell layer 150 may be replaced with some other type of inside padding, such as foam. The at least one outside gas cell layer 152 is attached to an outside surface of the thigh base shell 146. At least one securement strap 148 is attached to the base material 144. The at least one securment strap 148 is tightened to ensure that the thigh protective padding 86 stays positioned on a thigh.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A shoulder-chest protective pad comprising:

a vest for retention on a chest and shoulders of a user;

a left chest hard shell is attached to said vest;

at least one left outer gas cell layer is attached to an outside surface of said left chest shell, a left inside chest padding is retained on an inside surface of said left chest shell, said at least one left outer gas cell layer includes a left base sheet and a left cell sheet, a plurality of left gas cells are created by joining said left cell sheet to said left base sheet;

a right chest hard shell is attached to said vest, said left chest hard shell and said right chest card shell cover substantially all of a front of said vest; and at least one right outer gas cell layer is attached to an outside surface of said right chest shell, a right inside chest padding is retained on an inside surface of said right chest shell, said at least one right gas cell layer includes a right base sheet and a right cell sheet, a plurality of right gas cells are created by joining said right cell sheet to said right base sheet, said at least one left outer gas cell layer covers substantially all of an outer surface of said left chest hard shell, said at least one right outer gas cell layer covers substantially all of an outer surface of said right chest hard shell.

2. The shoulder-chest protective pad of claim 1 wherein:

said left inside chest padding is at least one left inner gas cell layer, said right inside chest padding is at least one right inner gas cell layer.

3. The shoulder-chest protective pad of claim 1, further comprising:

at least one securing strap for securing said shoulder-chest protective pad to a user.

4. The shoulder-chest protective pad of claim 1, further comprising:

a left shoulder shell extends from said vest adjacent said left chest shell; and a right shoulder shell extends from said vest adjacent said right chest shell.

5. The shoulder-chest protective pad of claim 4, further comprising:

at least one outside left shoulder gas cell layer is attached to an outside surface of said left shoulder shell; and at least one outside right shoulder gas cell layer is attached to an outside surface of said right shoulder shell.

6. The shoulder-chest protective pad of claim 4, further comprising:

a left tricep shell extends from a bottom of said left shoulder shell; and a right tricep shell extends from a bottom of said right shoulder shell.

7. The shoulder-chest protective pad of claim 6, further comprising:

at least one inside left tricep gas cell layer is attached to an inside surface of said left tricep shell; and at least one inside right tricep gas cell layer is attached to an inside surface of said right tricep shell.

8. A shoulder-chest protective pad comprising:

a vest for retention on a chest and shoulders of a user;

a left chest hard shell is attached to said vest;

at least one left outer gas cell layer is attached to an outside surface of said left chest shell, a left inside chest padding is retained on an inside surface of said left chest shell, said at least one left outer gas cell layer includes a left base sheet and a left cell sheet, a plurality of left gas cells are created by joining said left cell sheet to said left base sheet, each one of said plurality of left gas cells retains gas therein and does not pass the gas therein to an adjacent one of said plurality of left gas cells;

a right chest hard shell is attached to said vest, said left chest hard shell and said right chest card shell cover substantially all of a front of said vest; and at least one right outer gas cell layer is attached to an outside surface of said right chest shell, a right inside chest padding is retained on an inside surface of said right chest shell, said at least one right gas cell layer includes a right base sheet and a right cell sheet, a plurality of right gas cells are created by joining said right cell sheet to said right base sheet, each one of said plurality of right gas cells retains gas therein and does not pass the gas therein to an adjacent one of said plurality of right gas cells, said at least one left outer gas cell layer covers substantially all of an outer surface of said left chest hard shell, said at least one right outer gas cell layer covers substantially all of an outer surface of said right chest hard shell.

9. The shoulder-chest protective pad of claim 8 wherein:

said left inside chest padding is at least one left inner gas cell layer, said right inside chest padding is at least one right inner gas cell layer.

10. The shoulder-chest protective pad of claim 8 further comprising:

at least one securing strap for securing said shoulder-chest protective pad to a user.

11. The shoulder-chest protective pad of claim 8, further comprising:

a left shoulder shell extends from said vest adjacent said left chest shell; and a right shoulder shell extends from said vest adjacent said right chest shell.

12. The shoulder-chest protective pad of claim 11, further comprising:

at least one outside left shoulder gas cell layer is attached to an outside surface of said left shoulder shell; and at least one outside right shoulder gas cell layer is attached to an outside surface of said right shoulder shell.

13. The shoulder-chest protective pad of claim 11, further comprising:

a left tricep shell extends from a bottom of said left shoulder shell; and a right tricep shell extends from a bottom of said right shoulder shell.

14. The shoulder-chest protective pad of claim 13, further comprising:

at least one inside left tricep gas cell layer is attached to an inside surface of said left tricep shell; and at least one inside right tricep gas cell layer is attached to an inside surface of said right tricep shell.

* * * * *